US006095283A

United States Patent [19]

Ellis

[11] Patent Number: 6,095,283

[45] Date of Patent: Aug. 1, 2000

[54] WALK-THROUGH LADDER

[76] Inventor: J. Nigel Ellis, 306 Country Club Dr., Wilmington, Del. 19803

[21] Appl. No.: 09/258,205

[22] Filed: Feb. 26, 1999

[51] Int. Cl.[7] ..... E04B 3/00; E06C 9/00; E06C 7/18

[52] U.S. Cl. ..... 182/82; 182/106

[58] Field of Search ..... 182/82, 106, 93, 182/83–85, 113, 127, 194, 99

[56] References Cited

U.S. PATENT DOCUMENTS

| | | | |
|---|---|---|---|
| 2,432,189 | 12/1947 | Bucher et al. . | |
| 2,597,902 | 5/1952 | Roketa . | |
| 2,634,989 | 4/1953 | Skreberg | 182/106 |
| 2,641,785 | 6/1953 | Pitts et al. | 182/86 X |
| 4,130,177 | 12/1978 | Pandolph . | |
| 4,265,333 | 5/1981 | Rowell et al. | 182/106 X |
| 4,921,069 | 5/1990 | Boyles . | |
| 5,033,582 | 7/1991 | Hoben . | |
| 5,282,339 | 2/1994 | Devlin et al. | 182/106 |
| 5,692,582 | 12/1997 | Lindemood . | |

FOREIGN PATENT DOCUMENTS

| | | | |
|---|---|---|---|
| 470005 | 2/1992 | France | 182/106 |

OTHER PUBLICATIONS

Cotterman Co., Advertisement, (Publication Date Unknown).

*Primary Examiner*—Daniel P. Stodola
*Assistant Examiner*—Hugh B. Thompson

[57] ABSTRACT

A fixed ladder has a first plurality of parallel rungs arranged along a lower section thereof and also has a walk-through section with vertical side rails arranged at the top thereof. A second plurality of parallel rungs is arranged along the walk-through section. This second plurality of rungs is attached at one end to the vertical side rails of the walk-through section and is easier to hold then the vertical side rails if a foot or a climber slips near the top of the ladder while mounting or dismounting at the walk-through section.

25 Claims, 5 Drawing Sheets

WALK-THROUGH LADDER

CROSS-REFERENCE TO RELATED APPLICATION

This regular utility patent application is derived from Provisional Patent Application Ser. No. 60/102,897 filed on Oct. 2, 1998.

BACKGROUND OF THE INVENTION

1. Field of the Invention

The field of the invention is the art of walk-through ladders, inclusive of fixed ladders, which are permanently attached to a structure such as a building.

2. Description of the Related Art

A so called "through" ladder requires a climber getting off at the top to step through the ladder in order to reach a landing. "Walk-through" fixed ladders are also well known; they typically include a flared section at the top through which the climber walks. See the prior art device in FIGS. 8 and 9 which will be more fully described below.

Fall protection is mandatory through OSHA regulations on fixed ladders over 20 feet tall in general industry and 24 feet tall in construction. The addition of a post or a rail in the center or at the side of the ladder creates an impediment to circumvent so an outside fitting is safer. Ladders could be upgraded by having climbing safety devices installed as extra protection. About half of the ladders in use are less than 20 feet high so such improvements would serve the purpose well if no fall protection exists for these ladders.

One problem with the flared walk-through ladder is that the climber routinely holds a side rail while descending until the moment the flared section is reduced to 16 inches in width. Unless users observe the need to place the hands closer to the body in order to grasp the side rails or rungs on the main body of the ladder, a person will grasp at thin air and will be subject to a fall at that moment if he has transitioned his feet and assumed the location of the hand-hold by getting ready to release the other hand.

Moreover, when 2½–3-inch width angle iron is used as the side rail, only a push-pull pinch grip can be made on the side rails and any fall at the walk-through portion of the ladder is likely to be catastrophic in its outcome. In fact, the ability to hold any vertical shape of the side rails sufficiently to regain balance is not possible. The problems with side rail holdings are several.

First, the hand slides down due to the weight of the body. Second, the force of arresting a free fall up to three feet, i.e. the length of the arm, is dynamic. From rope tests, it is known that the maximum force of a moving rope which can be held is 50 pounds and the least is approximately 10 pounds, both far below a person's body weight. These references are found in the *ISFP Newsletter* of October, 1996.

Third, a swing fall into the side of the ladder produces an impact of the body with the ladder since the body's center of gravity has to move eight inches from center to side because a ladder rung is 16 inches long. If a person is standing far over to the side, then a movement of 16 inches will occur with an even higher swing fall collision which further tends to destabilize the hand grip.

Fourth, some ladder side rails are impossible to encircle with the hand, e.g., three-inch angle irons or two-inch flange I-beams. Because these shapes cannot be encircled with the hand for a good grip, only a pinch grip can be used and no fall arrest is remotely possible. With two-inch or 2½-inch widths, grips are possible but, due to the factors described above, the grip cannot become an effective grasp under foreseeable methods of climbing on these ladders and a catastrophe must necessarily follow, if the climber falls.

Fifth, the ground or surface below a fixed ladder is almost always unyielding, thus providing the maximum possible deceleration upon impact and therefore the greatest injury to a falling worker.

Sixth, ladders constitute the primary cause of injurious occupational falls based on current OSHA statistics. Since these statistics include portable ladders as well as fixed ladders, it is evident that a climber, who loses his balance on a ladder, needs all the help possible to maintain a grasp that can be reasonably effective if a foot were to slip at the most vulnerable transition points on the ladder.

All climbers eventually misstep no matter how well they are trained. Usually, the climber is preoccupied about achieving the purpose for which the ladder is climbed, not the actual climbing of the ladder. Therefore, exposure to fall hazards cannot be expected to be controlled effectively solely by training workers to climb ladders with the utmost attention to human factors and back-up safety features.

Typical of walk-through ladders in the prior art is the fixed ladder illustrated in FIGS. 8 and 9. A lower section of a walk-through ladder L is shown below a surface A which schematically represents a level to which a climber C is ascending from a lower surface G. The ladder L includes side rails 1 with a plurality of round foot rungs 2. By way of example, each rung 2 can be 16 inches long at a minimum and ¾ to one inch in diameter. Each side rail 1 can be 2½ inches wide by 3⅜ inch to one-half inch in thickness or any size or shape which provides a power grip with materials, such as carbon steel or aluminum, being selected appropriately for the ladder length, usage and environment.

As best shown in FIG. 8, the ladder L at its top above the surface A flares outwardly to form a walk-through section W. The architecture of the walk-through section W may vary depending upon requirements. However, the walk-through section W has parallel vertical side rails 21 and 22 forming an opening O generally, in order to meet code requirements, spaced apart at a distance one from the other about 24 to 30 inches.

As it is also seen in FIG. 9, the walk-through opening O is minimally 3½ feet in height. In this case, if the climber C is about 5'8" tall, the opening O may be about four feet high.

In FIG. 9, the climber C ascends the ladder L normally. As the climber C negotiates his way into and through the opening O, as indicated by arrows R, onto the surface A, the climber's feet may slip. The vertical side rails 21 and 22 of FIG. 8, regardless of shape or configuration, cannot be grasped without great risk of the climber's grip sliding and/or opening up, depending upon the nature of the slip. Furthermore, a free fall can develop from zero to twice the climber's arm length, resulting in an impact on any grip that the climber C may have. In addition, a swing to one side of the ladder L may result in an impact against the side rails 1 of the ladder L. Consequently, the climber's grip cannot be maintained and a hard fall to the surface C below usually occurs, resulting in serious injury or death.

SUMMARY OF THE INVENTION

This invention relates to a modification of walk-through ladders, namely, providing a second plurality of horizontal grasping rungs associated with the walk-through section which ordinarily does not have any such rungs. These extra rungs are provided for the climber to maintain a continuum of hand grips on the ladder. Such additional rungs are situated above the highest ladder rung. These higher horizontal grasping rungs are easier for the climber to grab and hold than the vertical side rails during passage up into and down from the walk-through section of the ladder, if a foot of the climber slips during such mounting and dismounting of the ladder.

DETAILED DESCRIPTION OF THE PREFERRED EMBODIMENTS

Figure 1:
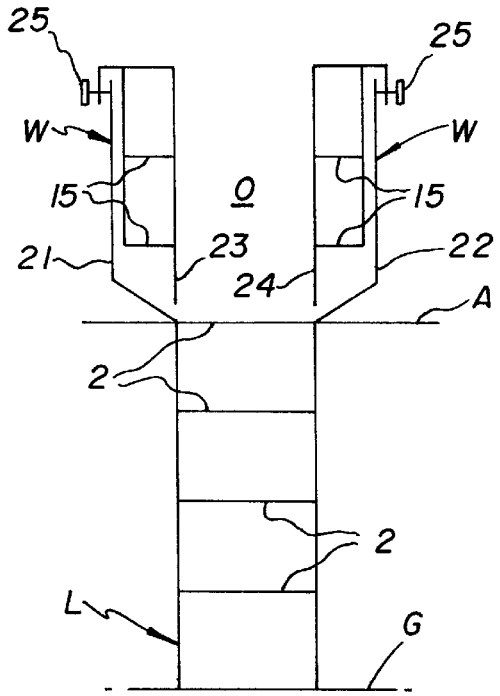
FIG. 1 is a front elevational view of a first embodiment of the invention.

As shown in FIG. 1, a second plurality of parallel, horizontal grasping rungs 15 are provided in association with the opening O in the walk-through section W of the fixed ladder L, thus allowing a climber C to grab one of the rungs 15 in the same fashion as the grasp enabled by the first plurality of rungs 2 in the lower climbing section of the ladder L.

Figure 7:
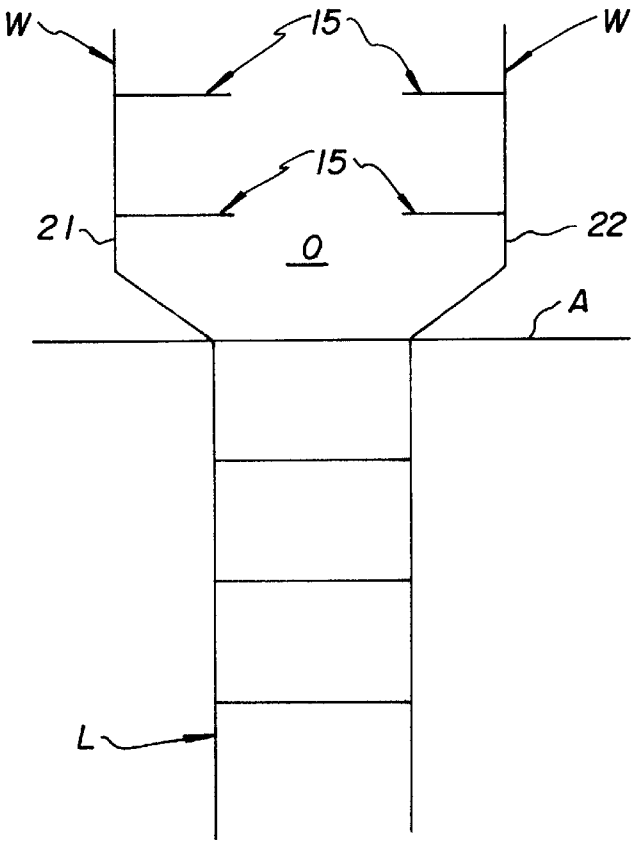
FIG. 7 is a front elevational view of a seventh embodiment.

As seen in the simplest embodiment illustrated in FIG. 7, the horizontal grasping rungs 15 extend freely at one end into the plane formed by the side rails 21 and 22 defining the opening O in the walk-through section W of the ladder above the surface A.

Any secure fixation or placement of the horizontal grasping rungs 15, whether by affixing them to the side rails 21 and 22 directly or otherwise by placing them securely at the required sites, is satisfactory. Moreover, although not necessarily in every structure providing the same level of protection, where the size of the opening O permits, the horizontal grasping rungs 15 may be placed proximate the opening O.

Figure 3:
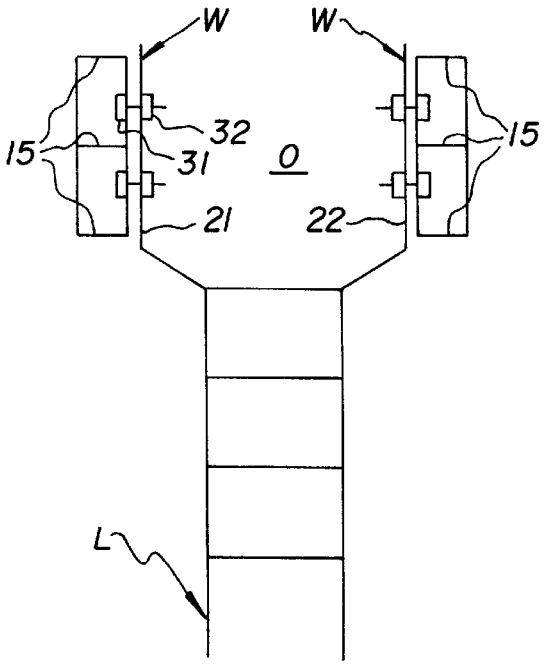
FIG. 3 is a front elevational view of a third embodiment.

As seen in the third embodiment in FIG. 3, the rungs 15 may be placed outside of the side rails 21 and 22 of the walk through section W. Thus, the horizontal grasping rungs 15 may be in the same plane as the opening O but affixed to the side rails 21 and 22 and extending outwardly therefrom rather than into the opening O of the walk-through section W.

This walk-through ladder improvement of the present invention is applicable to other fixed ladders used in industry and construction. For example, as seen in FIG. 1, it is applicable to a job-made ladder L by bolting the rungs 15 at one end to vertically oriented uprights 23 and 24 which extend above the surface A and are aligned parallel to the side rails 21 and 22.

Furthermore, the rungs 15 can be either built into new ladders at the time of fabrication or retrofitted to existing ladders.

The purpose of the improvement of the present invention is to provide rung-like grab-bars with spacing similar to the ladder rungs 2 which are further down in the lower section of the ladder L. Thus, the climber C who has the task of climbing up or down the ladder L can do so with greater security by holding onto the horizontal grasping rungs 15 rather than onto the vertical uprights 23 and 24 or the side rails 21 and 22 which cannot be grasped effectively for even short time periods if the climber's feet slip during mounting or dismounting from the walk-through section W. Dismounting is typically to a landing onto a roof, mezzanine, platform, parapet or other surface A that may be flat or sloped.

The results of a lost grip on the side rails 21 and 22 at the top of the ladder L can be catastrophic with long falls to the ground G or to a lower platform, thus resulting in serious injury or death in many cases each year. This kind of accident can occur even if there is a protective ladder cage (not shown) or if the climber's protection cable (not shown) has been disconnected.

It is preferable that the horizontal grasping rungs 15 associated with the walk-through section W be long enough for the climber's hand, either bare or gloved, to hold preferably 4 to 5 inches and up to 6 inches of the rung 15. Also, a diameter of about 1.5 inches is preferred for the rungs 15. Alternatively, rungs 15 of 0.75 inch diameter or other sizes may be welded or bolted for uniformity with the other rungs 2 to meet codes that require this uniformity over ergonomics.

Ordinarily after a slip, the hand of the climber C cannot hold the vertical side rail 21 or 22 long enough to regain his balance. Thus, a power grip is now required in the 1992 ANSI A14.3 Code Section. Such a power grip cannot be achieved with the prior art ladder which use side rail 2 of flat material with dimensions of either ⅜"×2" or ⅜"×2½".

The preferred material may be galvanized steel, stainless steel, aluminum, fiberglass or any other sturdy substance capable of holding the human body when the material is bolted on the ladder L. Improved fastening devices can be used to permit a mechanical attachment without the need to drill holes through the ladder L to attach metal bolts thereto. Instead, a single coupling 25, shown schematically in the first embodiment in FIG. 1, could be used for easy fitting of the rungs 15 on each side of the opening O to the side rails 21 and 22 of the walk-through section W.

The assembly including the walk-through section W with the horizontal grasping rungs 15 can be bolted together or welded with seamless joints in such a way that the welds will not break under a normal load or through corrosion or by any other reasonably destructive means.

Figure 2:
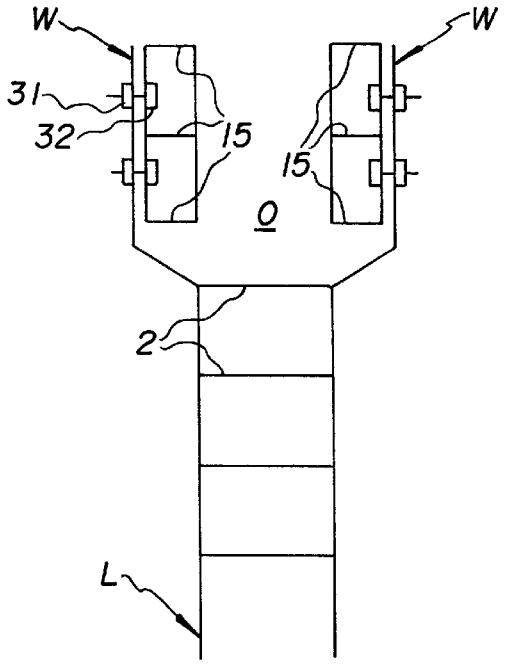
FIG. 2 is a front elevational view of a second embodiment.

The embodiment illustrated in FIG. 2 recognizes that the codes generally call for the flared walk-through section W at the top of the fixed ladder L to broaden outwardly from the rungs 2, which have a 16-inch minimum clear width, to the opening O, which has a clear width of 24 to 30 inches. The additional rungs 15 for climbing protection on the ladder L are accommodated in the opening O which is essentially a higher clear space up to 36 inches in width. However, as one skilled in the ladder art will readily appreciate, the opening O may be decreased in width for safety if it is so desired.

Because of the capability of the climber C to span 36 inches which is the maximum allowed by the 1992 A14.3 Code Section without loss of gripping power, the present invention is valuable for increasing safety. If an authority determines that the flaring of the walk through section W is unnecessary for safety and permits the present invention to be placed inside the flared walk-through section W, thereby narrowing the opening O and decreasing the fall space in the opening O, the improvement can be of great help to the climber C without sacrificing his ability to dismount properly, even if necessary to do edgewise, because of the increased hand grasping power allowed by the invention. Thus, the climber C can remount the ladder L for descent more easily and safely since the spacing and location of the rungs 2 and 15 are uniform for the entire length of the ladder L and the walk-through section W in FIG. 2.

The width of a climber's hips ranges from 11.1 to 16.4 inches across the front and a climber's buttocks range from 7.6 to 14.0 inches from front to back according to U.S. Army Mil-Std. 1472C (1980). Tools on the climber's body can add to these dimensions, so fitting in sideways helps minimize the climber's contact with the vertical uprights 23 and 24 in FIG. 1.

Figure 4:
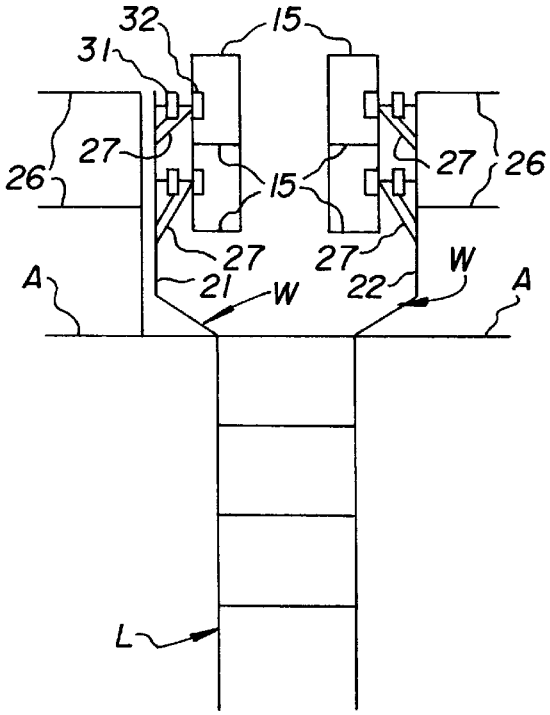
FIG. 4 is a front elevational view of a fourth embodiment.

If there are railings 26 as seen in FIG. 4, along the side rails 21 and 22, a fitting 27 may be added to allow the plurality of rungs 15 to be mounted to the side rails 21 and 22 inside the walk-through section W. This fourth embodiment helps the climber C to pull himself manually onto the surface A. Conversely for descent, the closer accessibility of the grasping rungs 15 will be helpful for maintaining confidence of gripping power as the climber C turns around to face the ladder L for descent.

Figure 5:
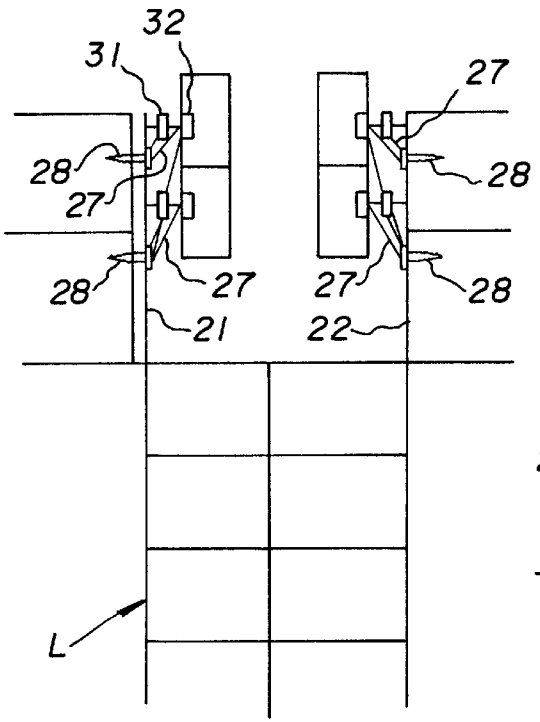
FIG. 5 is a front elevational view of a fifth embodiment.
Figure 8:
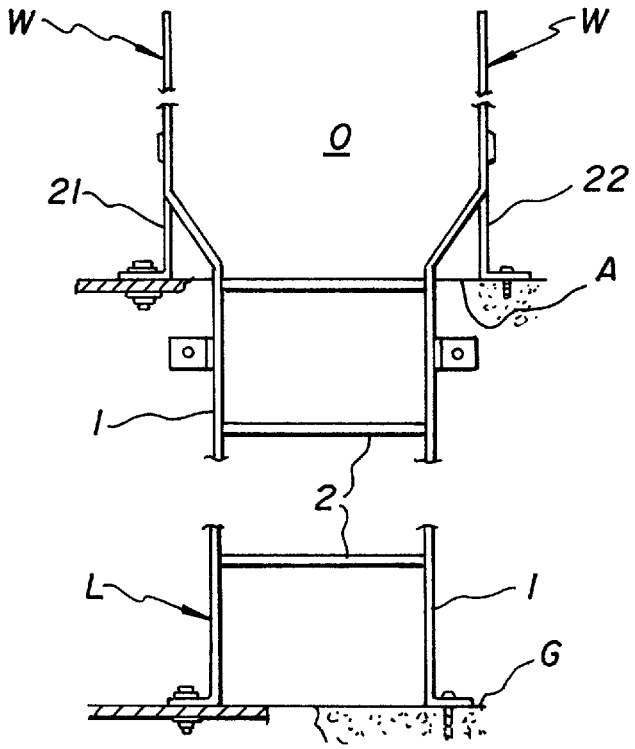
FIG. 8 PRIOR ART
FIG. 8 is a front elevational view of a prior art ladder.
Figure 9:
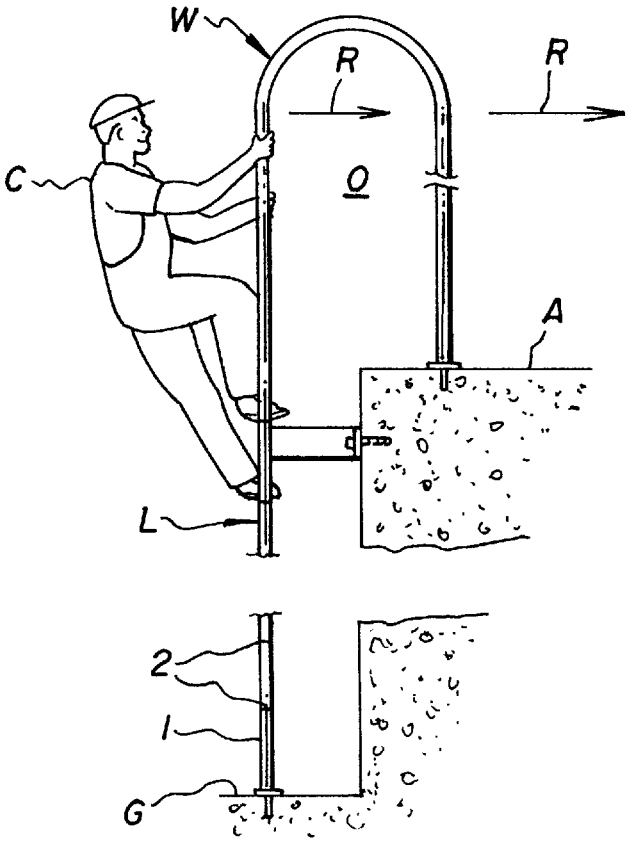
FIG. 9 PRIOR ART
FIG. 9 is a side elevational view of the prior art ladder.
Figure 12:
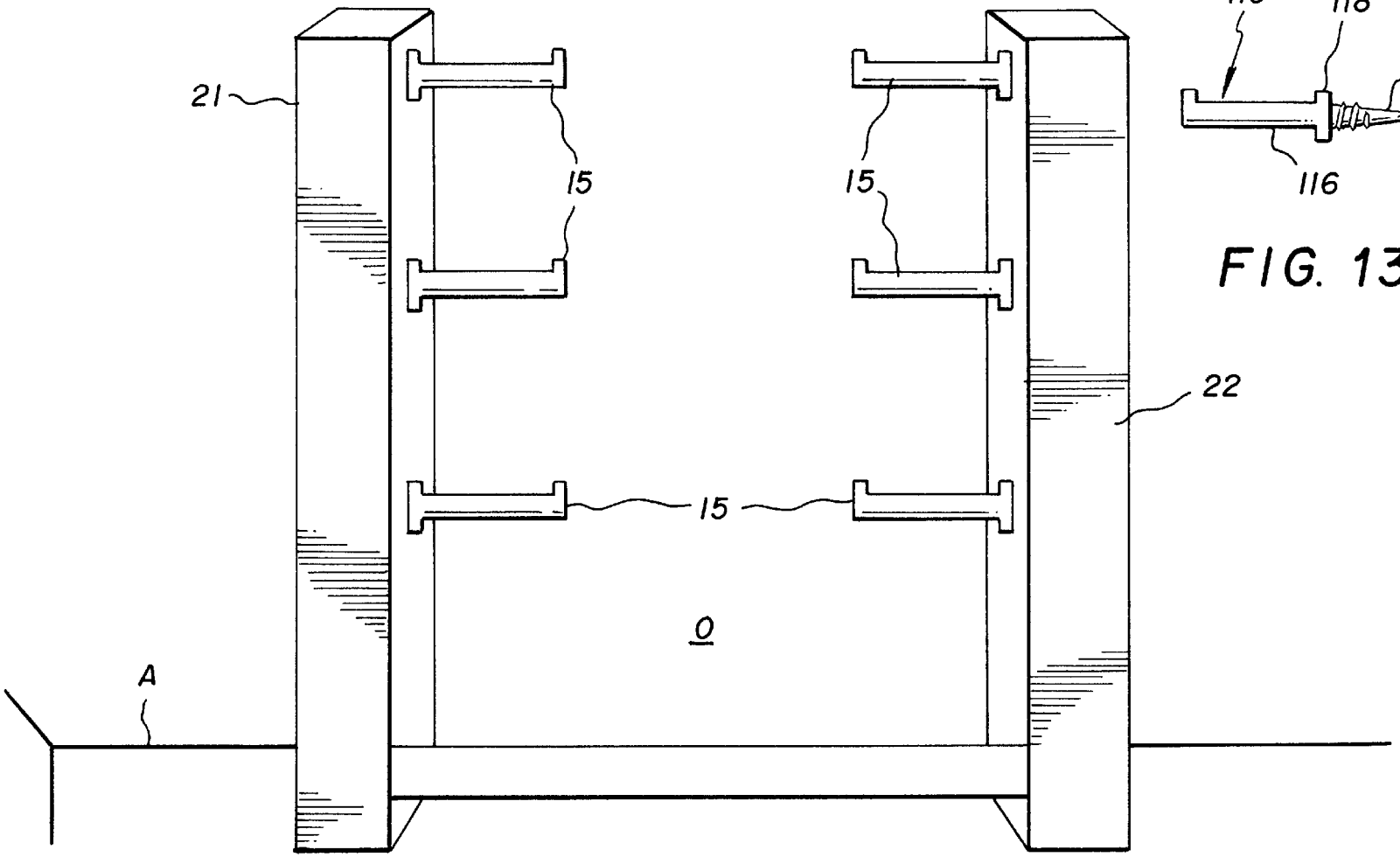
FIG. 12 is an alternative embodiment wherein horizontal grasping rungs replace traditional rungs.

As shown in FIGS. 5 and 12, a job-made ladder L can be very dangerous because the side rails 21 and 22 are typically lumber which is virtually impossible for the normal climber C to grasp in order to regain his balance when a slip or a fall occurs. The variation of the present invention illustrated in FIG. 5 shows how the improvement can work with 2×6-inch or 4×4-inch side rails 21 and 22 to increase safety through better handholds.

Figure 6:
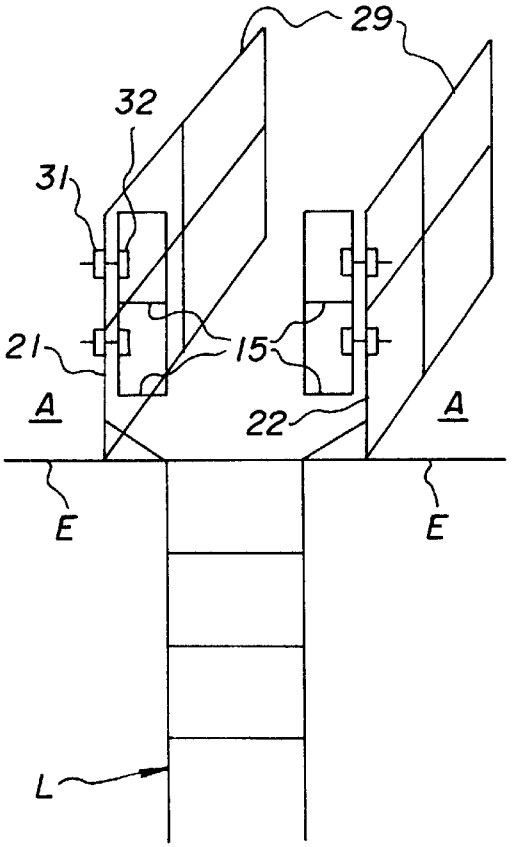
FIG. 6 is a schematic perspective view of a sixth embodiment.

Specifically, the fittings 27 may not be merely attached to one side of the rails 21 and 22, as seen in FIG. 4. Rather, as shown in the fifth embodiment of FIG. 5, fasteners 28 may pass through the side rails 21 and 22 to help secure the fittings 27 thereto.

Where no railings 26 are available as seen in the sixth embodiment of FIG. 6, attachments 29 provide railings back from an edge E of the surface A to which the ladder L is fixed. These attachments 29 extend back preferably six feet or more and provide protection on most commercial roof surfaces A. For a parapet ladder L, the horizontal grasping rungs 15 may be secured on both side rails 21 and 22 to the attachment 29 by double couplings 31 and 32. Such double couplings 31 and 32 may be bolt and nut connections. They are illustrated but were not previously discussed in the embodiments shown in FIGS. 2 through 5.

Other uses for the horizontal grasping rungs 15 as grab bars are also contemplated for any location where a comfortable handhold is needed to support balance, e.g., on machinery, cranes, platforms, and the like. Such arrangements are within the scope of the present invention.

Figure 11:
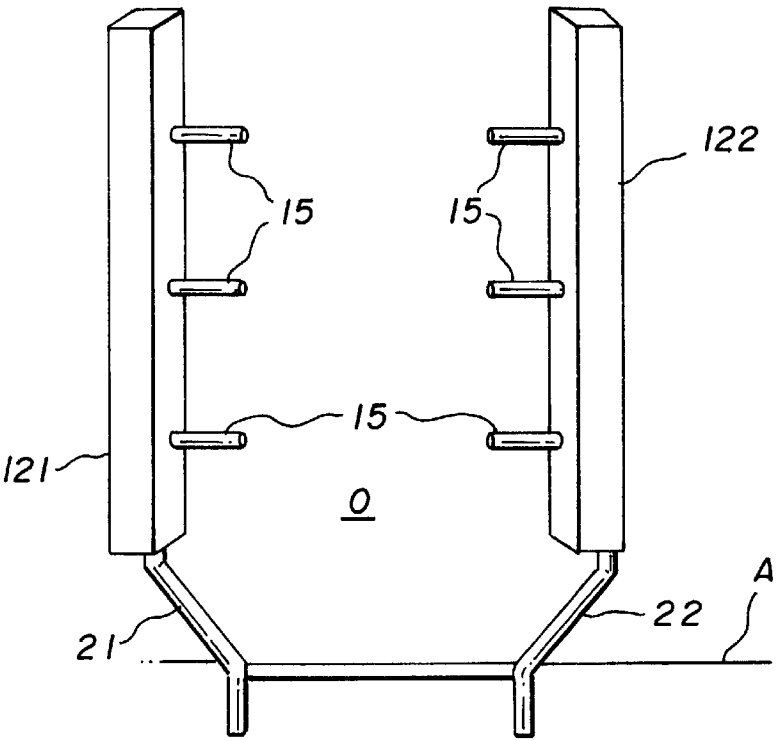
FIG. 11 is an alternative embodiment wherein side rails of a flared walk through section receive elongated sleeves such that the rungs of the sleeves are situated within a flared opening.
Figure 10:
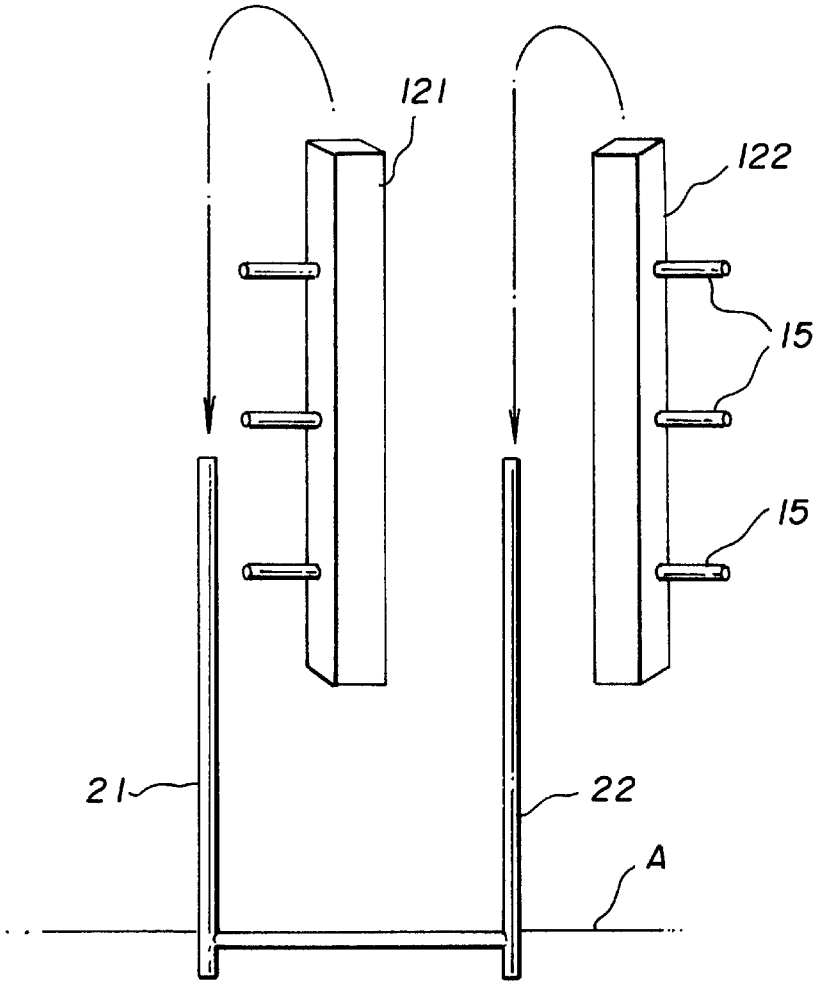
FIG. 10 is an alternative embodiment wherein a non-flared walk through section receives elongated sleeves at an upper end thereof so that rungs of the sleeves extend outwardly.

An embodiment of the present invention, where either a flared or non-flared fixed ladder (ladder not shown) is modified by placing elongated sleeves 121 and 122 over side rails 21 and 22, respectively, is shown schematically in FIG. 10. The sleeves are adapted to interfit over and be secured to the side rails. In FIG. 10, rung 15 placement on the sleeves is such that, after the sleeves are secured to the side rails, the rungs extend outwardly from the non-flared walk through area. In FIG. 11, an alternative sleeve configuration is shown schematically where the sleeves 121 and 122 are interfitted over flared side rails 21 and 22, respectively, with rungs 15 situated within the flared opening O.

Figure 13:
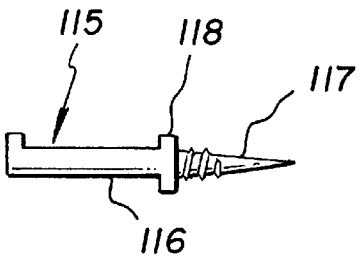
FIG. 13 shows the horizontal grasping rung of FIG. 12.

In yet another embodiment of the present invention, schematically illustrated in FIG. 12, the walk through section of a job made ladder is shown, wherein the side rails 21 and 22 (typically constructed using 1×1 inch or 4×6 inch wooden side rails) are modified by securely affixing horizontal grasping rungs 15 at locations and intervals in accordance with the present invention. Rungs 15 may be affixed to the side rails using rung-forming device 115 schematically shown in FIG. 13. The rung-forming device is comprised of a screw section 117, stop 118 and rung section 116. When device 115 is screwed into the side rail by driving in screw section 117, stop 118 contacts the side rail, when rung section 116 is properly positioned.

It should be apparent to persons of ordinary skill in the ladder art that numerous variations of the preferred embodiments described hereinbefore may be utilized and that, while this invention has been described fully and completely with special emphasis upon preferred embodiments, it should be understood that, within the scope of the appended claims, the invention may be practiced otherwise than as specifically described herein. In particular, the architecture of the walk-through section of the present invention can be used advantageously with numerous types of ladders, as will be appreciated by person's of ordinary skill in the ladder art and is not limited to fixed and/or flared walk-through ladders.

What I claim as my invention is:

1. A fixed ladder having a first plurality of parallel rungs defining a first plane arranged along a lower section thereof and a walk-through section with vertical side rails arranged at a top thereof, said walk-through section having a passageway between the vertical side rails, wherein the improvement comprises a second plurality of parallel rungs defining a second plane being arranged along the walk-through section and also being attached at one end to the vertical side rails of the flared walk-through section, said second plurality of parallel rungs leaving an opening which permits a worker to walk through the passageway, said first and second planes being substantially parallel.

2. A fixed ladder according to claim 1, wherein each of the second plurality of parallel rungs has a free end opposite to the one end which is attached to the vertical side rails of the walk-through section.

3. A fixed ladder according to claim 1, wherein the second plurality of parallel rungs is attached by a single coupling to each of the vertical side rails of the walk-through section.

4. A fixed ladder according to claim 1, wherein the second plurality of parallel rungs is arranged inside of the vertical side rails of the walk-through section.

5. A fixed ladder according to claim 1, wherein the second plurality of parallel rungs is arranged outside of the vertical side rails of the walk-through section.

6. A fixed ladder according to claim 1, wherein each of the second plurality of parallel rungs has an opposite end attached to vertically oriented uprights which extend parallel to the vertical side rails of the walk-through section.

7. A fixed ladder according to claim 1, wherein the second plurality of parallel rungs is attached by double couplings to each of the vertical side rails of the walk-through section.

8. A fixed ladder according to claim 7, wherein the double couplings are bolt and nut connections.

9. A fixed ladder according to claim 7, further comprising:

attachment means, attached to each of the vertical side rails of the walk-through section, for providing a railing that extends backwardly from the ladder.

10. A fixed ladder according to claim 7, wherein the second plurality of parallel rungs is also attached by fittings to each of the vertical side rails of the walk-through section.

11. A fixed ladder according to claim 10, wherein the fasteners further secure the fittings to each of the vertical side rails of the walk-through section.

12. A ladder having a first plurality of parallel rungs defining a first plane arranged along a lower section thereof and a walk-through section with vertical side rails arranged at a top thereof, said walk-through section having a passageway between the vertical side rails, wherein the improvement comprises a second plurality of parallel rungs defining a second plane being arranged along the walk-through section and also being attached at one end to the vertical side rails of the walk-through section, said second plurality of parallel rungs leaving an opening which permits a worker to walk through the walk-through section, said first and second planes being substantially parallel.

13. A ladder according to claim 12, wherein the rungs of said second plurality of parallel rungs are spaced apart a distance substantially the same as the distance between the first rungs of said first plurality of parallel rungs, said first and second parallel rungs being horizontal grasping rungs; whereby the worker climbing the ladder can maintain a continuum of horizontal hand grips in ascending and descending the ladder and in traversing the walk-through section.

14. A ladder according to claim 13, wherein the ladder is adapted to be permanently attached to a structure to be climbed.

15. A ladder according to claim 13, wherein the second plurality of parallel rungs is arranged inside of the vertical side rails of the walk-through section.

16. A ladder according to claim 15, wherein the walk-through section is flared with respect to vertical side rails of the ladder.

17. A ladder according to claim 16, wherein the ladder is adapted to be permanently attached to a structure to be climbed.

18. A ladder according to claim 15, wherein the ladder is adapted to be permanently attached to a structure to be climbed.

19. A ladder according to claim 13, wherein the second plurality of parallel rungs is arranged outside of the vertical side rails of the walk-through section.

20. A ladder according to claim 19, wherein the walk-through section is flared with respect to vertical side rails of the ladder.

21. A ladder according to claim 20, wherein the ladder is adapted to be permanently attached to a structure to be climbed.

22. A ladder according to claim 19, wherein the ladder is adapted to be permanently attached to a structure to be climbed.

23. A ladder according to claim 13, wherein the walk-through section is flared with respect to vertical side rails of the ladder.

24. A ladder according to claim 23, wherein the ladder is adapted to be permanently attached to a structure to be climbed.

25. A ladder according to claim 12, wherein the ladder is adapted to be permanently attached to a structure to be climbed.

* * * * *